US006460952B1

(12) United States Patent
Tryon

(10) Patent No.: US 6,460,952 B1
(45) **Date of Patent: *Oct. 8, 2002**

(54) STORAGE CABINET AND ASSEMBLY

(75) Inventor: John Frederick Tryon, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/557,781

(22) Filed: Nov. 13, 1995

Related U.S. Application Data

(63) Continuation-in-part of application No. 08/533,418, filed on Sep. 25, 1995, now Pat. No. 5,690,400, which is a continuation-in-part of application No. 08/473,686, filed on Jun. 7, 1995, now Pat. No. 5,688,032, which is a continuation-in-part of application No. 08/435,052, filed on May 8, 1995, now Pat. No. 5,688,031.

(51) Int. Cl.[7] ..... A47G 29/00
(52) U.S. Cl. ..... 312/265.5; 312/116; 312/400
(58) Field of Search ..... 312/114, 116, 312/140.1, 140.3, 138.1, 111, 107, 400, 357, 198, 278, 257.1, 265.6, 265.5; 206/423, 449, 349, 526; 248/254, 262, 267, 309.1; 52/79.1; 229/160

(56) References Cited

U.S. PATENT DOCUMENTS

| | | | | |
|---|---|---|---|---|
| 2,489,493 A | | 11/1949 | Kuenzie | |
| 2,526,989 A | * | 10/1950 | Wyman | 312/400 |
| 2,645,096 A | * | 7/1953 | Kuhn | 312/116 X |
| 2,710,241 A | * | 6/1955 | Lieberman | 312/351 |
| 2,894,604 A | * | 7/1959 | McMillan | 312/140.1 X |
| 3,297,373 A | | 1/1967 | Andrews et al. | |
| 3,847,250 A | | 11/1974 | Sherrill | |
| 3,897,855 A | * | 8/1975 | Patterson | 312/278 X |
| 3,961,456 A | * | 6/1976 | Manlove et al. | 52/716 |
| 4,073,556 A | * | 2/1978 | Wilson, Jr. | 312/138.1 X |
| 4,696,954 A | | 9/1987 | Pritchard et al. | |
| 4,790,610 A | * | 12/1988 | Welch et al. | 312/218 |
| 5,194,482 A | | 3/1993 | Chundury et al. | |

OTHER PUBLICATIONS

International Search Report completed on Sep. 20, 1996 and mailed on Oct. 8, 1996.

* cited by examiner

*Primary Examiner*—Peter M. Cuomo
*Assistant Examiner*—Stephen Vu

(57) ABSTRACT

A molded unitary storage cabinet and cabinet assembly for storage of supplies or retail stock, the cabinet assembly including at least two cabinet units; where the cabinet units are a butted or adjoined side by side; where each cabinet unit includes: inner and outer polymeric surfaces; formed by molding; where surfaces are defined by multiple joined surfaces; and where each cabinet unit comprises two side walls, one back wall, and a bottom or floor. The inner surfaces surround and define a hollow for containing, within the hollow, supplies or retail stock. An opening is formed in a front portion, opposite the back wall of the cabinet unit, for access to the hollow for storing supplies or retail stock. The back wall of the cabinet unit has an opening for allowing access to electrical outlets, plumbing, and other resources. A serving/work surface is fixedly attached to the upper edges of the side walls and back wall. The top portion of the serving/work surface may be used for placement of retail food and drink dispensers.

19 Claims, 7 Drawing Sheets

STORAGE CABINET AND ASSEMBLY

RELATED APPLICATION

This application is a continuation-in-part of patent application Ser. No. 08/533,418 filed Sep. 25, 1995, now U.S. Pat. No. 5,690,400, issued on Nov. 25, 1997, entitled Cabinet Assembly Comprising Multiple Identical Molded Cabinet Units, which is a continuation-in-part of patent application Ser. No. 08/473,686, filed Jun. 7, 1995, now U.S. Pat. No. 5,688,032, issued on Nov. 18, 1997, entitled Work and Storage Cabinet Assembly Having Multiple Identical Cabinet Units Formed by Rotational Molding, which is a continuation-in-part of patent application Ser. No. 08/435,052, filed May 8, 1995, now U.S. Pat. No. 5,688,031, issued on Nov. 18, 1997, entitled Storage Cabinet Assembly Having Multiple Identical Cabinet Units Formed by Rotational Molding.

FIELD OF THE INVENTION

The invention relates to a polymeric unitary storage cabinet and cabinet assembly for containing supplies or retail stock and for providing a counter surface for a service/work surface or for storage of supplies/retail stock. A cabinet assembly comprises a plurality of cabinet units.

BACKGROUND OF THE INVENTION

Retail stores have a need for many types of storage, display, and serving fixtures. Goods must be visibly displayed for the customer's easy access. Extra inventory must be stored until needed. Where the goods are ready-to-eat self-serve food and drink items, a serving surface is necessary for the customer.

Such needs are present, for example, in convenience stores. In a convenience store the customer may, for example, purchase a hot dog and soft drink. These items are typically self-serve. Thus, it is necessary to have a counter top for holding the drink, ice and cup dispenser, the hot dog rotisserie, and the plates, napkins, table ware and condiments.

Such a counter top ideally requires only low maintenance, has a long life, and can be readily installed in a variety of floor plan configurations. A modular design is desirable so as to reduce manufacturing cost. A single (unitary) piece basic cabinet unit is desirable to reduce assembly problems and to eliminate the irregularities which arise when each cabinet unit requires separate assembly. It would be desirable to have such a counter top also having internal storage capacity for extra supplies and goods. The counter top and associated assembly should be made of an inexpensive material that is durable, easily cleaned, and of light weight. The present invention addresses all of the above problems and provides a cabinet unit and assembly to meet the above discussed needs.

SUMMARY OF THE INVENTION

The invention includes a modular, unitary, molded cabinet unit and an assembly of such units for storage of supplies or retail stock, the cabinet assembly including at least two cabinet units; where the cabinet units are a butted or fixedly adjoined side by side; where each cabinet unit includes: inner and outer polymeric surfaces; formed by molding; where the surfaces form multiple joined surfaces; and where each individual cabinet unit has only two side walls, one back wall, and a bottom or floor, i.e., it is molded without a front or top surface. The joined surfaces surround and define a hollow (when a top surface is installed) for containing, within the hollow, supplies or retail stock. An opening is formed in a front portion of the cabinet unit for access to the hollow for storing supplies or retail stock. The back wall of the cabinet unit has an opening for allowing access to electrical outlets, plumbing, refrigeration and other resources which may be located behind the back wall. A serving/work surface is fixedly attached to the upper edges of the side and back walls. The top portion of the serving/work surface may, for example, be used for placement of retail food and drink dispensers.

DETAILED DESCRIPTION OF THE PREFERRED EMBODIMENT

Overview and Benefits

Figure 1A:
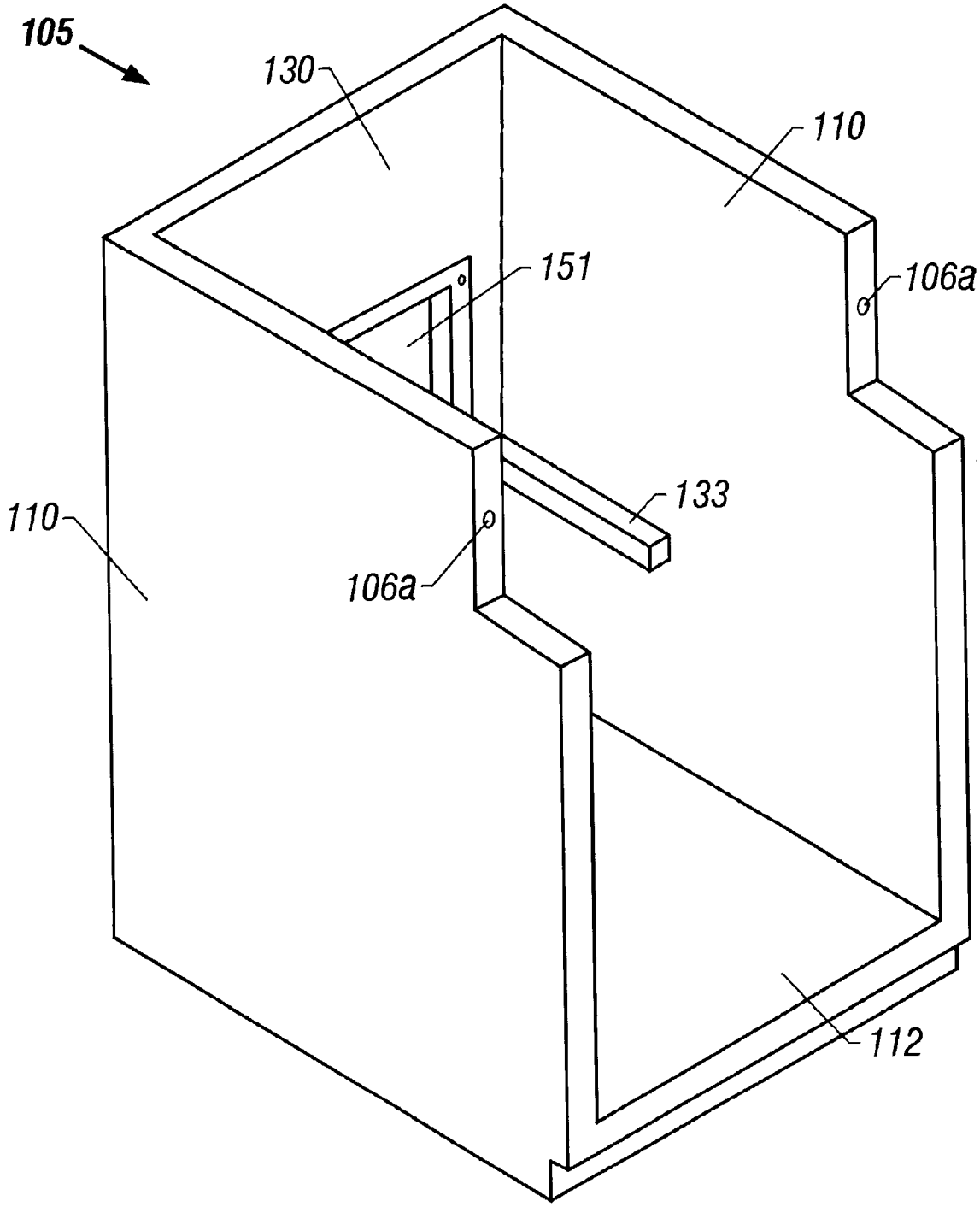
FIG. 1A is an isometric drawing of the basic, modular, unitary, molded cabinet unit without a valance or door panel installed.
Figure 1B:
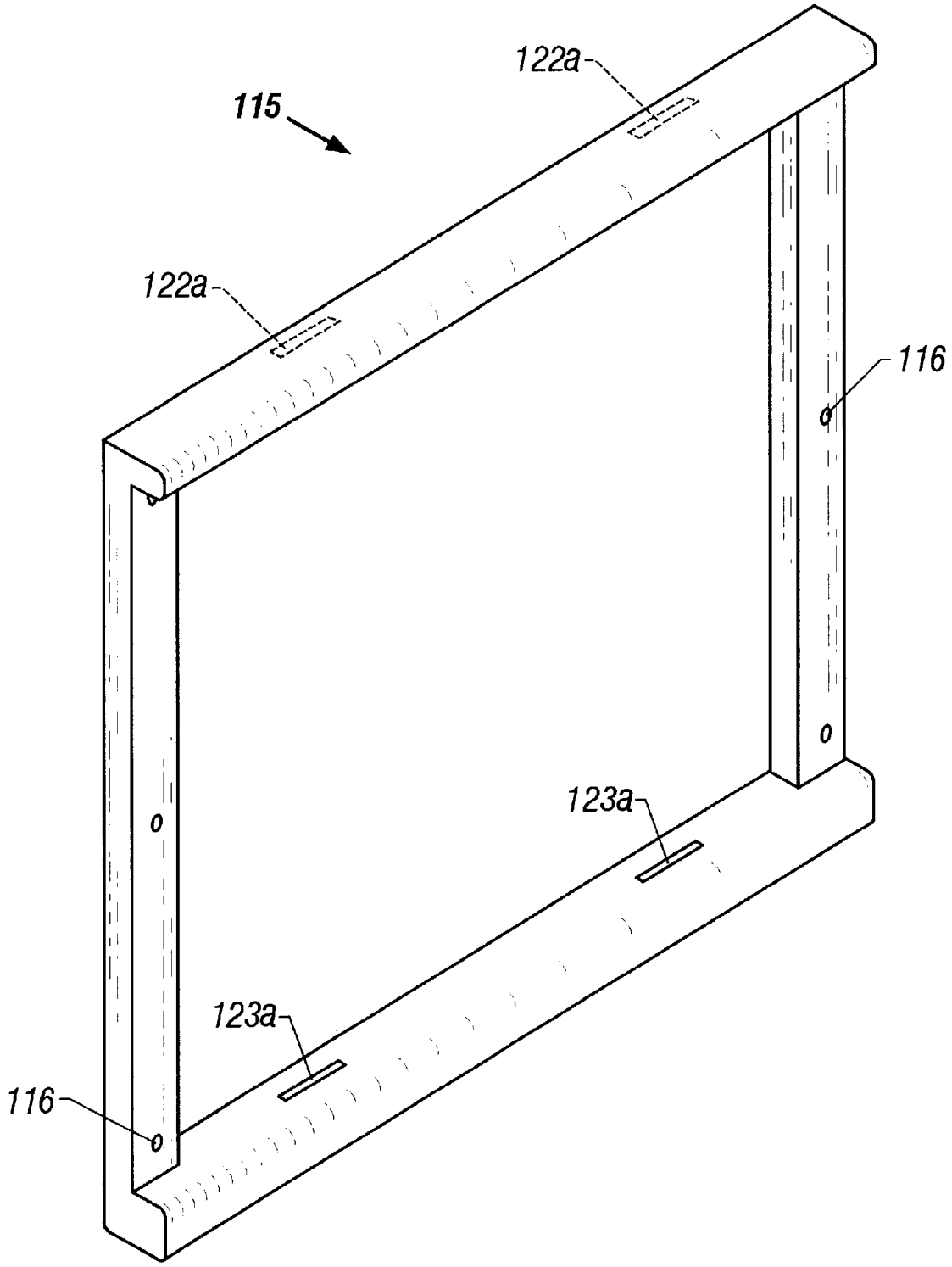
FIG. 1B is an isometric drawing of the valance.
Figure 1C:
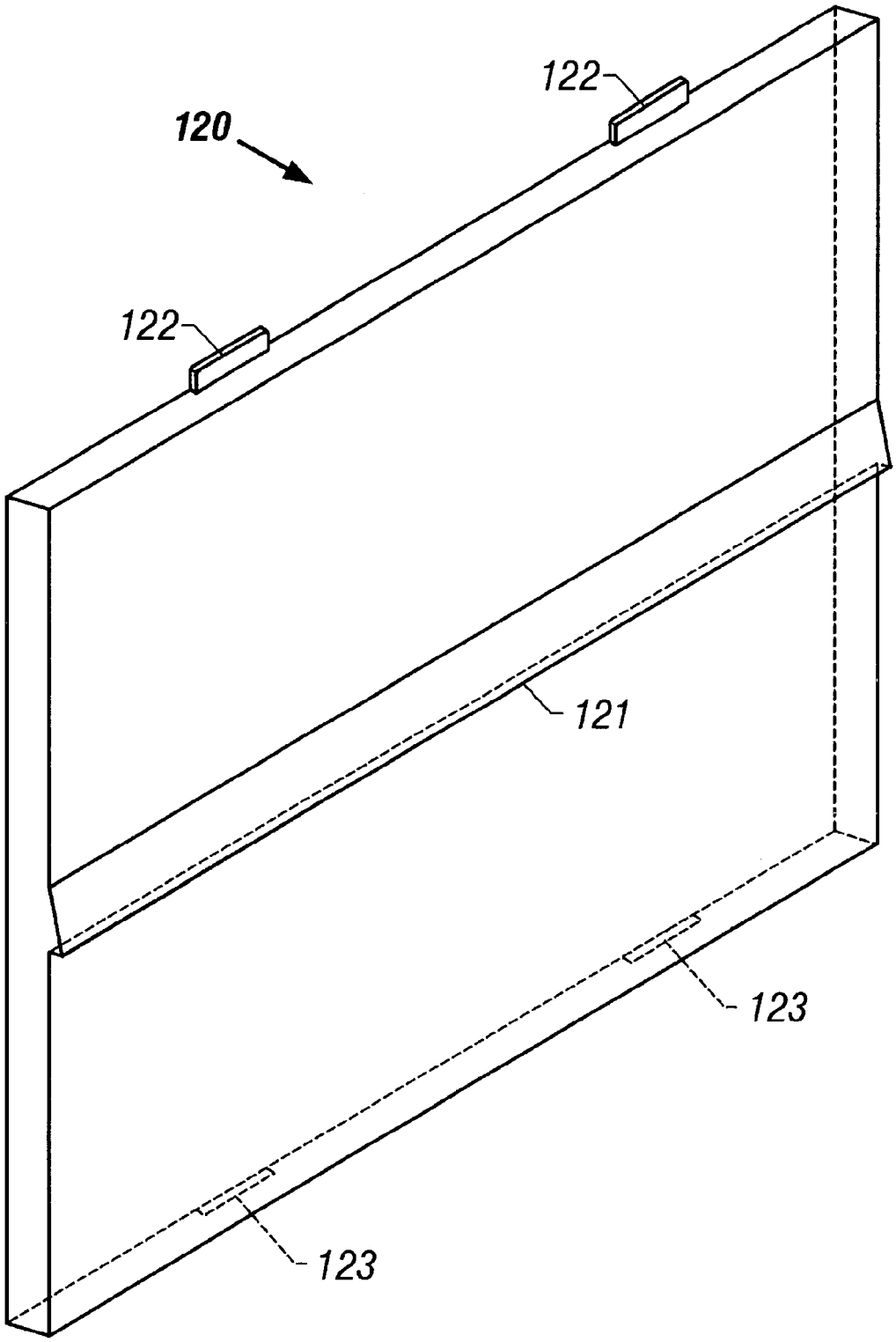
FIG. 1C is an isometric drawing of the door panel.

The cabinet assembly of the invention is designed to provide a work surface or a serving surface for food and to provide internal storage space for extra goods and supplies or otherwise for general storage/surface needs. Such uses are practical for example in convenience stores, homes hospitals, off-shore marine installations, boats, ships retail stores, laundries, cafeterias, and/or restaurants. The design is modular, meaning there is a common single, unitary cabinet unit. The side walls, floor, and back of each cabinet unit are molded in a single piece, self-supporting design requiring no assembly and providing little or no deviation in dimensions between each cabinet unit. A plurality of these cabinet units can be adjoined or abutted side by side to construct a cabinet assembly of the necessary size for any particular store floor plan. A single piece design also facilitates easy installation and removal or replacement of individual cabinet units. Where an adhesive is used to attach the serving/work surface, installation and removal can be done without tools, excluding adjustment of the adjustable footings and attachment of the valance where the valance is attached by screws.

The Components

The cabinet assembly includes the following components:

Abutting Cabinet Units:

The cabinet assembly includes at least two cabinet units. The cabinet units are abutted side by side or are optionally fixedly adjoined side by side. One side of one cabinet unit abuts one side of the other abutting cabinet unit.

Cabinet Unit Design:

Each cabinet unit includes an inner polymeric surface and an outer polymeric surface. These inner and outer polymeric surfaces are either separate (spaced apart) polymeric shells or they may be inner and outer wall surfaces of a single, homogeneous polymeric construction. This will depend on the method of manufacture. Rotational molding can be used to produce single or double-walled construction. Double-wall rotational molding, typically, results in separate shells and may include a lower-density "foam" polymer (such as polyurethane) injected in between. Reaction injection molding, "RIM," results in a cabinet unit having substantially consistent wall density both at its inner and outer surfaces and between the inner and outer surfaces, i.e., it is homogeneous. The inner and outer surfaces are integrally joined and formed by molding, such as by rotational molding described above or by other molding processes well known in the art. The inner and outer surfaces are typically separated by a distance of from about 0.5 inches to about one inch and the inner surface is typically substantially parallel to the corresponding outer surface. The inner and outer surfaces form a plurality of integrally joined surfaces. The completed cabinet unit resembles a box without a top and front.

Walls:

Each cabinet unit includes only two side walls, one back wall and one bottom wall or floor surface, i.e., the cabinet unit is molded without a top or front panel surface. The walls surround and define a hollow for containing, within the hollow, supplies or retail stock. The separately attached serving/work surface will define the top of the hollow. The bottom or floor surface of the cabinet unit may optionally have threadably adjustable footings attached thereto for leveling the cabinet assembly on an uneven floor surface where it is to be installed. The bottom or floor of the cabinet unit optionally may have access holes in its top portion for adjustment of the footings. The bottom of the floor surface of the cabinet unit is optionally recessed in a center portion to add structural strength to the cabinet unit and reduce overall weight. The top front portions of the side walls are preferably notched, such as an L-shaped notch, or recess. This recess is used for receipt of supplies or retail stock/goods by means of a variety of interchangeable plug-in units such as condiment trays, napkin holders and/or a cup dispenser. One type of plug-in unit serves to extend the service/work surface.

Front Opening:

An opening is formed in a front portion of the cabinet unit, due to absence of a front panel. This opening is for allowing access to the hollow for storing supplies or retail stock. The opening is bounded and defined on the sides by forward edges of each of the side walls and, on the bottom, by the forward edge of the floor of the cabinet unit. The opening is typically bound on the top by the forward edge of the serving/work surface.

Valance:

A four-sided valance frame is fixedly attached to the circumference of the front opening. The valance frame has two side members and an optionally integrally joined top and bottom member. Thus the valance forms a four-sided frame. It attaches by any conventional means such as adhesive or, preferably, screws to the front edges of the side walls and floor. The bottom surface of the top member of the valance and the top surface of the bottom member of the valance are optionally each configured for detachable attachment of a door panel. For example, if a tongue and grove method of attaching the door panel is used, then the top member and bottom member surfaces of the valance will have grooves for receipt of the corresponding tongue portions on the door panel.

Storage Door Panel:

A storage door panel is removably attached, for example, by tongue and groove attachment means, to the bottom surface of the top member of the valance and the top surface of the bottom member of the valance. When attached, the storage door panel covers the front opening of the valance and may be easily detached for access to goods and supplies stored in the hollow. The door panel is removed from the valance by lifting at the integrally molded door lift until the bottom tongues of the door panel clear their corresponding mating grooves in the valance, then pulling the bottom of the door panel toward the user.

Back Wall Service Opening:

The back wall of the cabinet unit typically has an opening therein for allowing access to electrical outlets, plumbing, refrigeration and other resources which may be located behind the back wall.

Detachable Back Wall Service Door Panel:

A detachable service door is optionally removably attached, such as by screws, over the opening in the back wall.

Internal Shelves:

One or more shelves are optionally removably attached to the side walls to span the hollow from side wall to side wall and thereby provide storage shelving as needed to maximize storage capacity. The shelves are attached by any conventional means. Integral ledges for support of the shelves are preferably incorporated into the inner side of the side walls.

Work/Serving/Storage Surface:

A serving/work surface is fixedly attached to the upper edges of the side walls, back wall, and top member of the valance frame. The top portion of the serving/work surface is for placement of supplies or retail stock such as food and drink dispensers or for providing a work surface. The surface may have an optional back restraining panel portion substantially vertical thereto for preventing goods on the serving surface from sliding off the back edge.

Molding

The cabinet unit is manufactured by molding. This includes rotational molding, RIM molding, and structural foam molding. Generally, rotational molding involves injection of a powdered or liquid state polymer into a mold. The mold is then heated and rotated around several axes to distribute the powdered polymer. When the powdered polymer is heated, it melts and flows together along the mold thus forming surfaces conforming to the shape of the mold. A "foam" (i.e., less dense) polymer, such as polyurethane, can optionally be added between the inner and outer surfaces. The foam can be a different material from the inner and outer surfaces and can be injected between those two surfaces. Alternatively, the "foam" can be formed of the same material as the inner and outer surfaces. In this process, before all of the initial polymer is heat set to form the inner and/or outer polymeric shells, an appropriate chemical additive is injected into the unset polymer which causes it to "foam" and set. Preferred polymers for rotational molding include polyolefins such as polyethylene, polycarbonates, nylons, polyvinylchloride and thermoplastic polyesters, with the most preferred being polyethylene. Preferred polymers for RIM and structural foam molding include polyurethanes, epoxy resins, polyesters and nylons, with polyurethane being most preferred. For further information, rotational molding is described at 14 Encyclopedia of Polymer Science and Engineering 659–670 (2nd Ed. 1988) and reaction injection molding at pp. 72–100. Other conventional molding techniques are optionally used to manufacture other components of the cabinet assembly, such as the top surface, the valance and the door panels which are preferably formed by vacuum/pressure forming. Other techniques include injection molding, blow molding compression forming, and match die forming, all processes generally known to those skilled in the art.

Assembly and Installation

Various steps may be used in assembling and installing the cabinet assembly. Typically, the desired number of cabinet units are placed in the proper location in the store. They are positioned side by side. Optionally, they may be fixedly attached to each other at the abutting sides. The adjustable footings are then adjusted to account for any unevenness in the flooring of the building where the units are to be installed. A single serving/work surface is then installed to lie on the top of the upper edges of the side and back walls of the multiple cabinet units. A single lower kick panel is then optionally installed at the bottom front portion of the floor of the cabinet unit. Typically, instead of a single lower kick panel, tiles are layered, by adhesive for example, to the bottom front portion of the cabinet unit to give a uniform appearance to this portion of the cabinet assembly. If a condiment tray or drink dispenser is utilized, these are then installed along with a transparent sneeze guard, if desired. Other types of plug-in units may be installed depending upon the desired use.

DETAILED DESCRIPTION OF THE DRAWINGS

FIGS. 1A–1D and FIG. 2

Figure 1D:
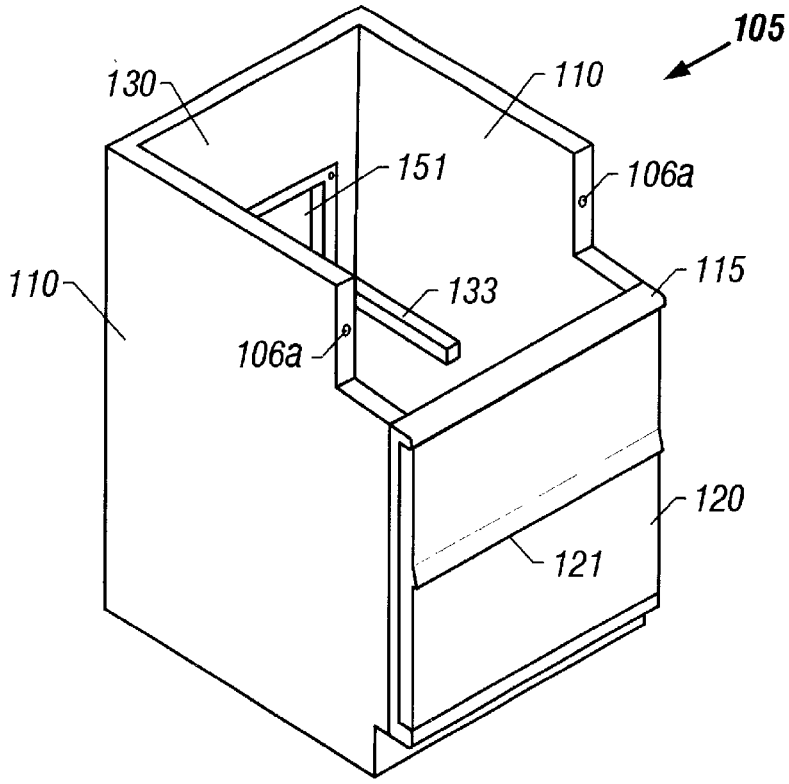
FIG. 1D is an isometric drawing of the basic cabinet unit with a valance and a door panel installed.

FIGS. 1A–1D are isometric drawings of the basic modular, unitary cabinet unit 105 (FIG. 1A), the valance 115 (FIG. 1B), the door panel 120 (Fig. 1C) and the valance 115 and door panel 120 installed on a cabinet unit 105 (FIG. 1D).

Figure 2:
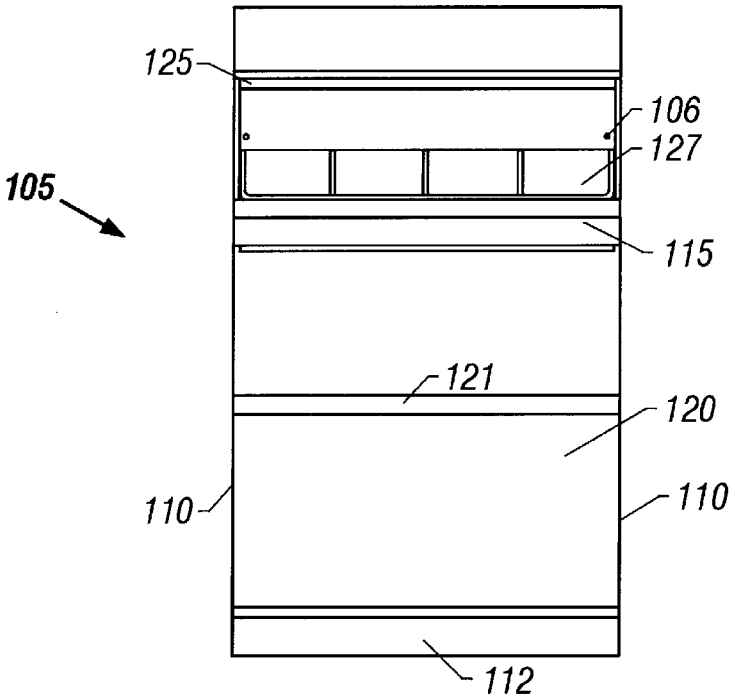
FIG. 2 shows a front view of one embodiment of a single cabinet unit with a valance, door panel and condiment tray installed.

FIG. 2 shows a front view of one embodiment of a single cabinet unit 105. With reference to FIGS. 1A–1D and FIG. 2, side walls 110 on the left and right sides and rear wall 130 extend upward from bottom or floor surface 112. Valance 115 is attached to cabinet unit 105 by means of screws through screw holes 116 and frames the circumference of the opening formed by the forward edges of side walls 110 and bottom or floor 112. Storage door panel 120 is removably attached to valance 115 to cover the opening. This operation is more thoroughly described in conjunction with the description of FIG. 4. Serving/work surface 125 is fixedly attached to the top edges of side walls 110 and the rear wall 130 (not shown in FIG. 2). Condiment trays 127 are removably positioned on a front portion of the cabinet unit 105 and are preferably covered by a sneeze guard 145 (See FIG. 4).

FIG. 3

Figure 3:
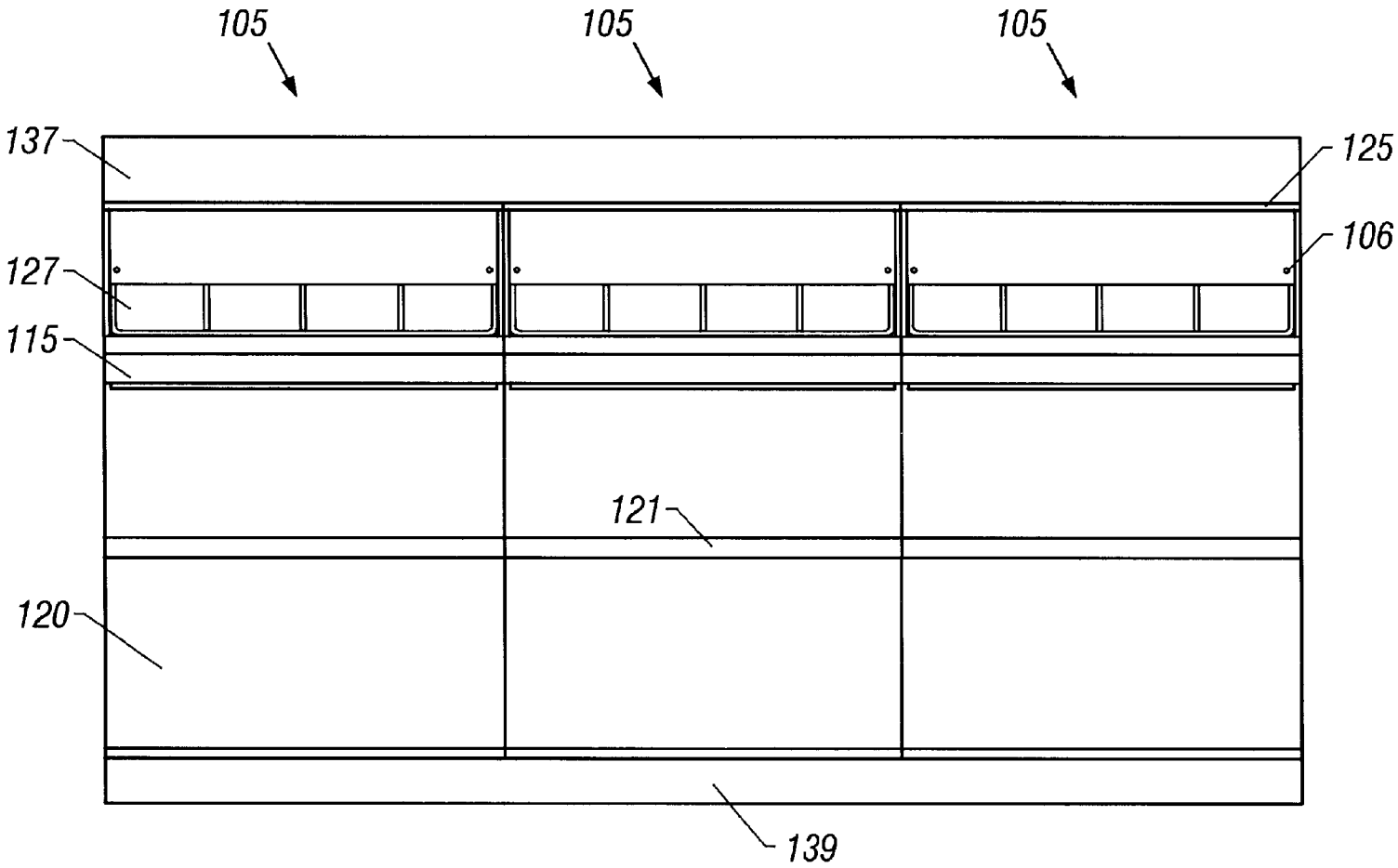
FIG. 3 units front view of one embodiment of three cabinet units fixedly adjoined side by side and having valances, door panels and condiment trays installed.

FIG. 3 shows a front view of one embodiment of a cabinet assembly comprising three cabinet units 105 fixedly adjoined side by side. The same reference numbering is used for the elements of the cabinet units as in FIGS. 1A–1D and FIG. 2. When two or more cabinet units 105 are adjoined side by side, the serving surface 125 is preferably a single panel so as to give a smooth, continuous counter surface. Similarly, a single kick panel 139 is optionally fixedly attached to the front portions of the bottom or floor surfaces 112 to provide a continuous appearance. Serving surface 125 optionally has an integral or fixedly attached rear panel 137 along the back portion of serving surface 125 to prevent goods from being pushed off the back of the serving panel 125. Back restraining panel 137 is substantially vertically oriented and may be a single continuous panel when more than one cabinet units are adjoined side by side.

Figure 4:
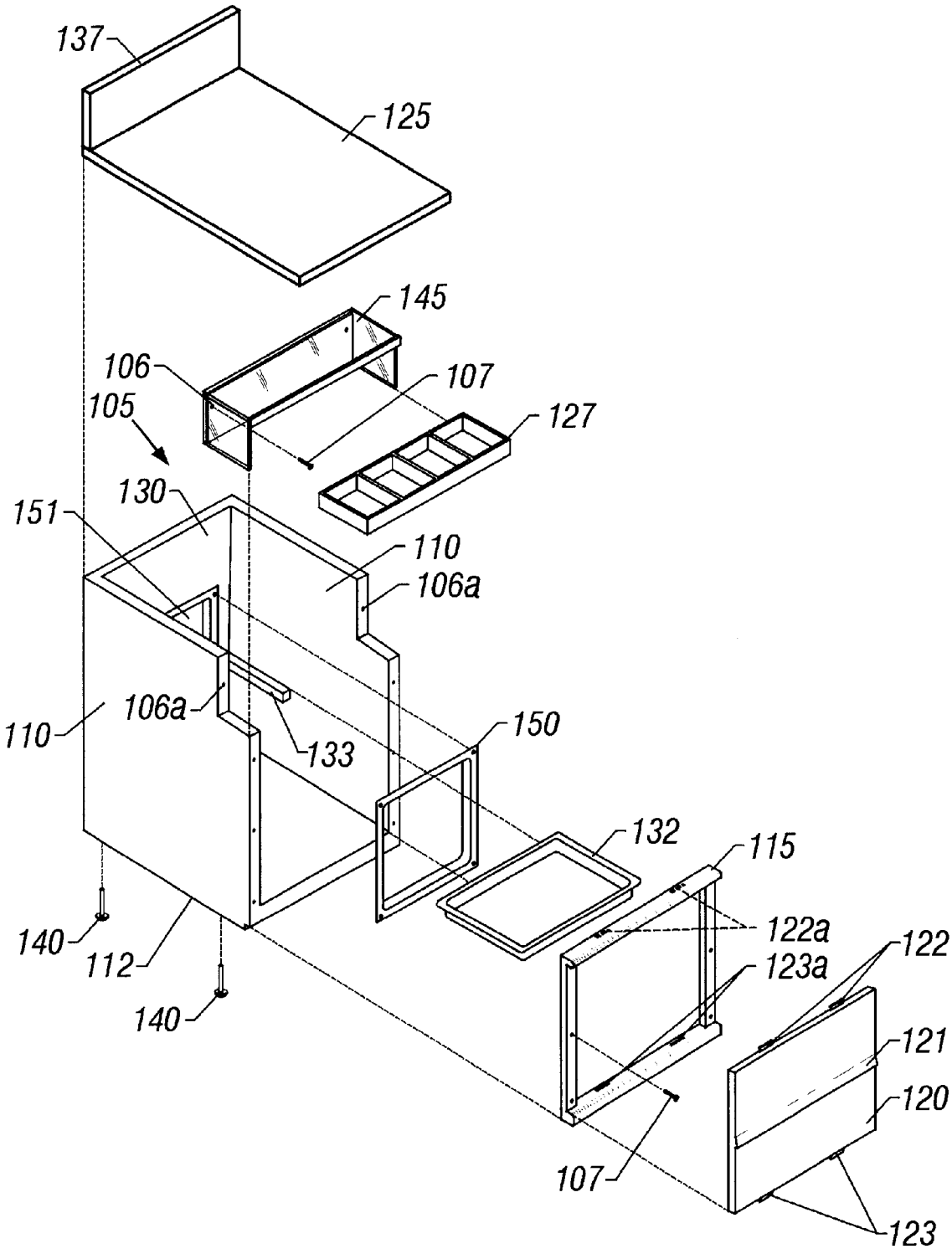
FIG. 4 shows an exploded isometric view of the details of one embodiment of a single cabinet unit.

FIGS. 4 and 5

FIG. 4 shows an exploded isometric view of the details of one embodiment of a single cabinet unit. Back wall 130 is integrally molded with side walls 110 and bottom or floor surface 112. Back wall 130 may have an opening 151 there in for access to utilities in any building wall against which the cabinet unit 105 is placed. Detachable service door 150 is removably attached to back wall 130 to allow access to utilities through the opening 151 in back wall 130.

Figure 5A:
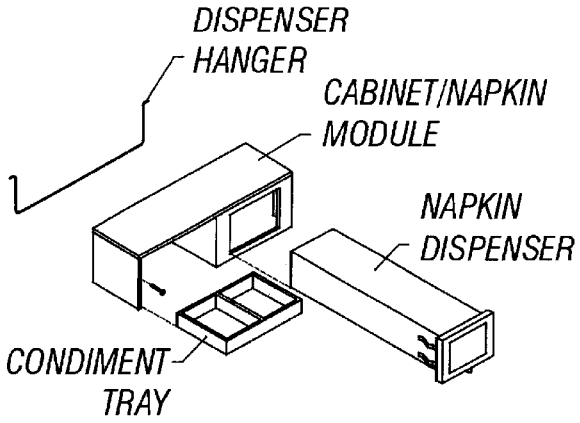
FIGS. 5A–5F show a variety of plug-in units which may be used in the cabinet assembly of FIG. 4.
Figure 5B:
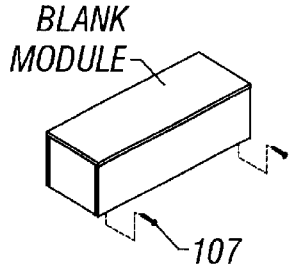
Figure 5C:
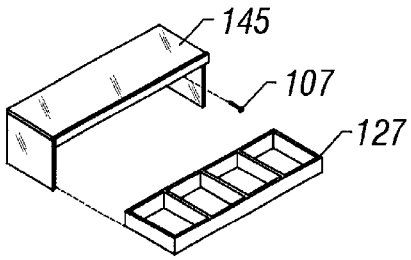
Figure 5D:
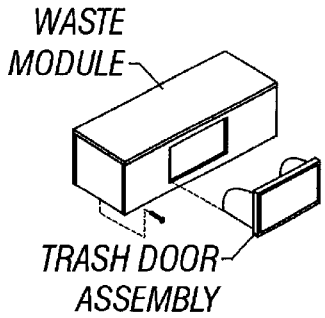
Figure 5E:
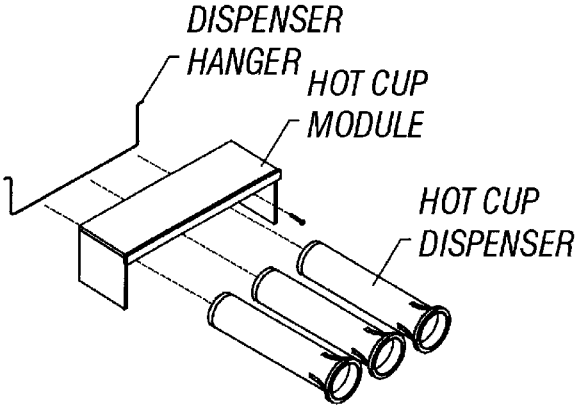
Figure 5F:
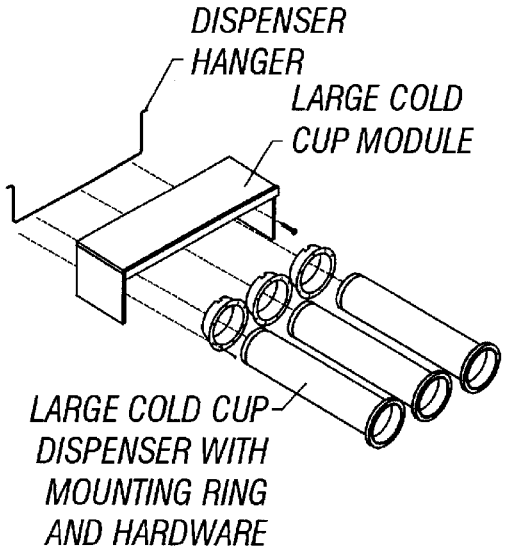

Bottom or floor 112, optionally has adjustable footings 140 threadably attached. By rotating the threaded footings to different lengths the cabinets 105 may be made stable, even on uneven flooring. Sneeze guard 145 is optionally place d over condiment trays 127 in the L-shaped cutouts in the top front portion of side walls 110. The sneeze guard 145 is typically made of transparent plastic or glass and is open in its front for access to the condiment tray 127. Sneeze guard 145 may be attached to the cabinet unit 105 by thumb screws 107 inserted through holes 106 in sneeze guard 145 and seated in the threaded recesses 106*a* in the riser portion of the L-shaped cutouts in side panels 110. Although the sneeze guard 145 and condiment tray 127 are used herein for the purpose of illustration, the L-shaped cutouts or notches may be used for plug-in units other than the sneeze guard 145 and condiment tray 127, shown more clearly in FIG. 5C. For example, the notch space may be used to place other plug-in units for, e.g., dispensing napkins (FIG. 5A), providing a blank space (FIG. 5B), providing for trash disposal (FIG. 5D) or for dispensing drinking cups for hot and cold beverages (FIGS. 5E and 5F, respectively). The notch may also provide for additional counter or work space. In each of these configurations, the plug-in unit is attached by the same thumb screw means 107 as is used to install the sneeze guard 145, i.e., the plug-in units are easily interchangeable. Inside the cabinet unit 105, optional shelf 132 is removably attached to side walls 110, preferably by means of ledges (shelf supports) 133 molded into side walls 110. Additional shelves may be added to maximize the storage capacity of the cabinet unit 105.

Storage door panel 120 is molded with a triangular-shaped raised portion 121 on its front surface which serves as a door lift. The upper and lower edges of door panel 120 include tongues 122, 123, respectively which mate with corresponding grooves 122*a*, 123*a*, respectively, in the mating surfaces of valance 115. Other door lift configurations may be used such as knobs or indentations.

Where adhesives are used instead of screws, many types may be used, the preferred being sold under the tradename LIQUID NAILS.

What is claimed is:

1. A modular cabinet unit comprising:

a polymeric material molded in a unitary construction, said unitary construction consisting of one floor, one back wall and two side walls.

2. The cabinet unit of claim 1 wherein said two side walls include matching L-shaped notches in their top front edges and wherein said matching L-shaped notches are adapted to receive a removable plug-in unit.

3. The cabinet unit of claim 2 further including a sneeze guard located in said L-shaped notches in the top front edges of said side walls.

4. The cabinet unit of claim 3 further including a removable tray adapted to be placed within an outline of said sneeze guard.

5. The cabinet unit of claim 1 further comprising:

a top panel fixedly attached to top edges of said back and side walls to thereby define a hollow bounded by said floor, said back wall, said two side walls and said top panel.

6. The cabinet unit of claim 5 further including a valance fixedly attached to and covering front edges of said cabinet unit, said valance having four sides and being open in its central portion thereby framing the boundaries of said hollow.

7. The cabinet unit of claim 6 further including a door panel removably attached within the open central portion of said valance.

8. The cabinet unit of claim 7 further including means for removably attaching said door panel within said valance.

9. The cabinet unit of claim 8 wherein said means for removably attaching includes tongues on the upper and lower edges of said door panel and corresponding mating grooves on inward facing edges of said valance.

10. The cabinet unit of claim 9 wherein said two side walls include matching L-shaped notches in their top front edges and wherein said matching L-shaped notches are adapted to receive a removable plug-in unit.

11. The cabinet unit of claim 10 further including a sneeze guard located in the L-shaped notches in the top front edges of said side walls.

12. The cabinet unit of claim 11 further including a removable tray adapted to be placed within an outline of said sneeze guard.

13. A modular cabinet unit comprising:

a plurality of polymeric surfaces molded in a unitary construction, said surfaces consisting of one bottom surface, one back surface and two side surfaces;

a top panel fixedly attached to top edges of said back and side surfaces to thereby define a hollow bounded by said bottom surface, said back surface, said two side surfaces and said top panel;

a valance fixedly attached to and covering front edges of said cabinet unit, said valance having four sides and being open in its central portion thereby framing the boundaries of said hollow;

a door panel removably attached within the open central portion of said valance;

means for removably attaching said door panel within said valance;

wherein said means for removably attaching includes tongues on the upper and lower edges of said door panel and corresponding mating grooves on inward facing edges of the opening in said valance;

wherein said two side surfaces include matching L-shaped notches in their top front edges and wherein said matching L-shaped notches are adapted to receive a removable plug-in unit;

a sneeze guard located in the L-shaped notches in the top front edges of said side surfaces; and a removable tray adapted to be placed within an outline of said sneeze guard.

14. A modular cabinet unit comprising:

a plurality of polymeric surfaces molded in a unitary construction, said surfaces consisting of one bottom surface, one back surface and two side surfaces;

a top panel fixedly attached to top edges of said back and side surfaces to thereby define a hollow bounded by said bottom surface, said back surface, said two side surfaces and said top panel;

a valance fixedly attached to and covering front edges of said cabinet unit, said valance having four sides and being open in its central portion thereby framing the boundaries of said hollow; and a door panel removably attached within the open central portion of said valance.

15. The cabinet unit of claim 14 further including means for removably attaching said door panel within said valance.

16. The cabinet unit of claim 15 wherein said means for removably attaching includes tongues on the upper and lower edges of said door panel and corresponding mating grooves on inward facing edges of said valance.

17. The cabinet unit of claim 16 wherein said two side surfaces include matching L-shaped notches in their top front edges and wherein said matching L-shaped notches are adapted to receive a removable plug-in unit.

18. The cabinet unit of claim 17 further including a sneeze guard located in the L-shaped notches in the top front edges of said side surfaces.

19. The cabinet unit of claim 18 further including a removable tray adapted to be placed within an outline of said sneeze guard.

* * * * *